US006974128B2

(12) United States Patent
Quesnel

(10) Patent No.: US 6,974,128 B2
(45) Date of Patent: Dec. 13, 2005

(54) SHEET REGISTRATION DESKEW WITH PLURAL ARCUATE INDEPENDENTLY REPOSITIONABLE BAFFLES

(75) Inventor: Lisbeth S. Quesnel, Pittsford, NY (US)

(73) Assignee: Xerox Corporation, Stamfort, CT (US)

( * ) Notice: Subject to any disclaimer, the term of this patent is extended or adjusted under 35 U.S.C. 154(b) by 237 days.

(21) Appl. No.: 10/458,415

(22) Filed: Jun. 10, 2003

(65) Prior Publication Data

US 2004/0251613 A1 Dec. 16, 2004

(51) Int. Cl.[7] ..... B65H 7/02
(52) U.S. Cl. ..... 271/227; 271/242; 271/188
(58) Field of Search ..... 271/254, 242, 271/241, 227, 188, 218

(56) References Cited

U.S. PATENT DOCUMENTS 4,262,895 A * 4/1981 Wenthe, Jr. ..... 271/65
5,904,350 A * 5/1999 Creighton et al. ..... 271/227
6,805,347 B2 * 10/2004 Kuramoto ..... 271/242

* cited by examiner

*Primary Examiner*—Donald P. Walsh
*Assistant Examiner*—Kaitlin Joerger

(57) ABSTRACT

A sheet registration system in an arcuate sheet path of a compact printer with a sheet feeding system in which the lead edge of the sheet is partially arcuately buckled against a transversely extending registration gate in said sheet path (such as stalled or slower speed sheet feed roller nips, or retractable fingers) in which there is a transversely variable arcuate control baffle system in said sheet path upstream of the registration gate for accommodating skewed sheets in the sheet path and thereby providing improved alignment of the lead edge of the skewed sheets with the transversely extending registration gate. The illustrated transversely variable arcuate control baffle system is provided by a variably positionable split baffle system providing for a larger arcuate buckle for one side of a skewed sheet than the other side of the skewed sheet. This may be in proportion to a sensed initial skew of the sheet.

8 Claims, 3 Drawing Sheets

Figure 1:
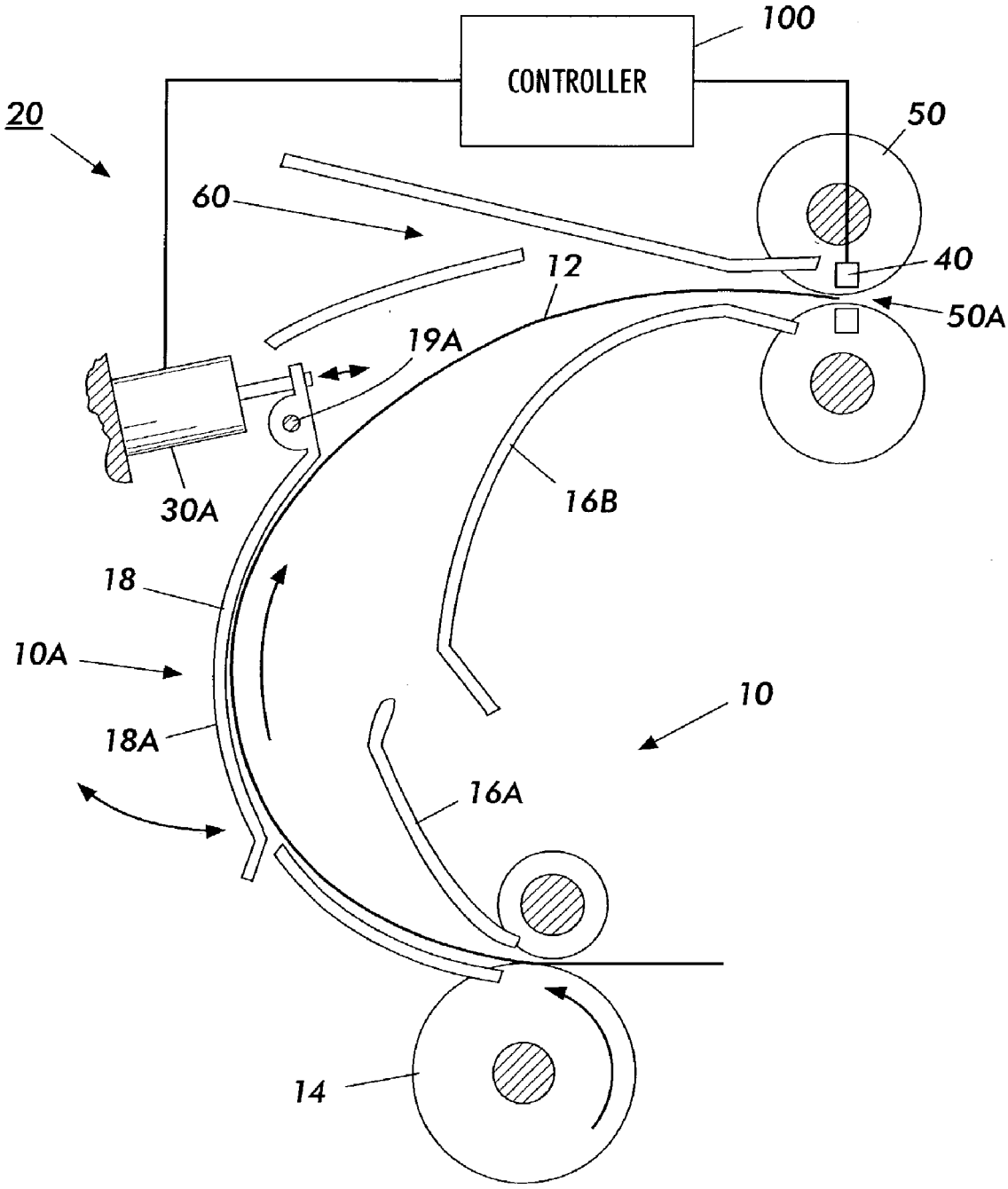

SHEET REGISTRATION DESKEW WITH PLURAL ARCUATE INDEPENDENTLY REPOSITIONABLE BAFFLES

Disclosed in the embodiment herein is an improved system for sheet registration in sheet registration systems in which the lead edge of a sheet in the sheet path is temporarily partially buckled against a transversely extending registration gate, wherein a transversely variable arcuate control baffle system in the sheet path upstream of the registration gate can automatically accommodate skewed sheets in the sheet path and providing improved alignment of the lead edge of the skewed sheets with the transversely extending registration gate.

By way of general background, various types of sheet registration systems are well known to those skilled in the art. A common sheet registration system in the sheet path of a printer or copier is one in which the lead edge of the sheet is partially arcuately buckled against a transversely extending registration gate in the sheet path. The registration gate may be proved by temporarily stalled or slower speed sheet feed roller nips, or retractable fingers. Typically the sheet to be registered is driven up against the registration gate and slightly buckled thereagainst, until the lead edge of the sheet is aligned therewith, until that sheet is released at the desired registration time or position, so as to be subsequently fed on in the process direction to be printed with the desired registration relative to the image.

The following patent disclosures are noted merely by way of some examples thereof, and also showing also how old this art is even for xerographic printing sheet registration systems: Xerox Corp. U.S. Pat. No. 3,281,144, issued Oct. 25, 1966 and U.S. Pat. No. 3,601,392, issued Aug. 24, 1971.

Particularly noted as to prior art on movable sheet path baffles to control the sheet path is Xerox Corp. U.S. Pat. No. 6,155,561, issued Dec. 5, 2000 by Barry Mandel.

Stalled roller sheet registration is preferably performed on a flat section of the paper path, which enables the sheet to more easily buckle and rotate (deskew) correctly to fully move into registration. That is, with the lead edge of the sheet fully transversely aligned with the transversely extending stalled rollers registration nips.

However, many desirably small footprint reproduction machine architectures have compact paper paths. They may desire or be constrained to place the duplex and/or simplex buckle chambers for stalled roller sheet registration and deskew in a curved (arcuate) section of the paper path. In that case, for example, it may be desired or constrained to position the upstream pre-registration sheet feeding nip by as much as 180° of paper path curvature, and by as much as 140 mm or more in paper path distance, away from the downstream stalled rolls registration nips.

This can create problems in buckling a skewed sheet correctly into the temporarily stalled rolls while the sheet is in such a constrained arcuate sheet path. The sheet continues to hug or rub against the outermost sheet path baffle defining the curved sheet path outer wall, even if that single baffle is hinged and pivoted to allow the sheet to buckle by a greater amount. The sheet cannot differentially move away from that outer curved wall, with a result that deskew performance can be degraded. This problem can be exacerbated by weak beam strength sheets, such as thinner or lighter-weight paper. Simply providing a single fixed buckle chamber of constant spacing transversely of the paper path may not be sufficient to fully deskew the lead edge of the sheet in this situation, because the sheet can maintain its level of skew, rather than rotate, as it is forced to maintain its same buckle shape against the inside surface of the outside baffle defining the curved paper path.

However, because of their low cost, as compared to other registration systems, stalled roll sheet registration systems are desirable in many such printing systems. That can include original document sheet feeding for imaging in scanners or copiers as well as print media sheets being registered before or after they are printed.

In contrast, in the illustrated exemplary embodiment herein, a split baffle is provided with independent partial baffle movements from one transverse side of the sheet path relative to the other (inboard versus outboard), which enables the sheet to maneuver differently, inboard versus outboard, into the stalled rolls registration nips. That is, in this exemplary embodiment, the curved baffle is split into left and right, inboard and outboard, sections which are movable relative to one another for skewed sheets. The number of such independently moveable arcuate sections illustrated herein is two, but could be three or four, if desired. Two is believed to be normally sufficient, and preferred. In this embodiment, these baffle sections are shown as operating independently to bias the sheet into the stalled registration nip correctly for proper alignment (deskewing registration). Thus, the inboard end of the sheet is enabled to move by a different amount of buckle (buckle length), than the outboard or opposite end of the sheet if the sheet is skewed. This differential sheet buckling provides improved sheet deskewing and thus improved registration.

A specific feature of the specific embodiment disclosed herein is to provide a sheet registration system for a sheet path with a sheet feeding system in which the lead edge of the sheet is partially arcuately buckled against a transversely extending registration gate in said sheet path, the improvement comprising a transversely variable arcuate control baffle system in said sheet path upstream of said registration gate for accommodating skewed said sheets in said sheet path by providing improved alignment of the lead edge of said skewed sheets with said transversely extending registration gate.

Further specific features disclosed in the embodiment herein, individually or in combination, include those in which said transversely variable arcuate control baffle system comprises a variable position split baffle system providing for a larger arcuate buckle for one side of a skewed sheet than the other side of the skewed sheet in said variable position split baffle system; and/or wherein said registration system is in the sheet path of a printer for providing registration of the sheet relative to an image to be printed onto the sheet; and/or in which said larger arcuate buckle for one side of a skewed sheet than the other side of the skewed sheet in said variable position split baffle system is provided in proportion to a sensed initial skew of the sheet; and/or a skewed print media sheet registration system for an arcuate sheet path defined by a sheet path baffles system and having an upstream sheet feeding system and a downstream registration gate, in which a skewed sheet in said arcuate sheet path is driven against said downstream registration gate by said upstream sheet feeding system and temporarily partially buckled in said arcuate sheet path, wherein a sheet skew sensing system is provided, and wherein said sheet path baffles system is transversely differentially positioned in proportion to a sensed initial skew of the sheet by said sheet skew sensing system to provide a larger arcuate buckle space for one side of the skewed sheet than the other side of the skewed sheet; and/or wherein said sheet path baffles system comprises differentially pivotal laterally split baffles controlling at least a portion of said arcuate sheet path to provide said larger arcuate buckle space for one side of the skewed sheet than the other side of the skewed sheet; and/or a method of skewed print media sheet registration in an arcuate sheet path in which a skewed sheet in the arcuate sheet path is driven from upstream against a downstream registration gate and temporarily partially buckled therebetween in the arcuate sheet path, wherein a larger arcuate buckle is provided for one side of the skewed sheet than the other side of the skewed sheet in proportion to a sensed initial skew of the sheet; and/or the method of skewed print media sheet registration in an arcuate sheet path in which said larger arcuate buckle is provided for one side of the skewed sheet than the other side of the skewed sheet by automatically differentially repositioning a laterally differentially repositionable outer sheet baffle defining at least a part of said arcuate sheet path.

The disclosed system may be operated and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images. The term "transversely extending registration gate" herein broadly encompasses conventional or other temporarily stalled or slowed speed sheet feed roller nips, retractable fingers, etc.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Figure 2:
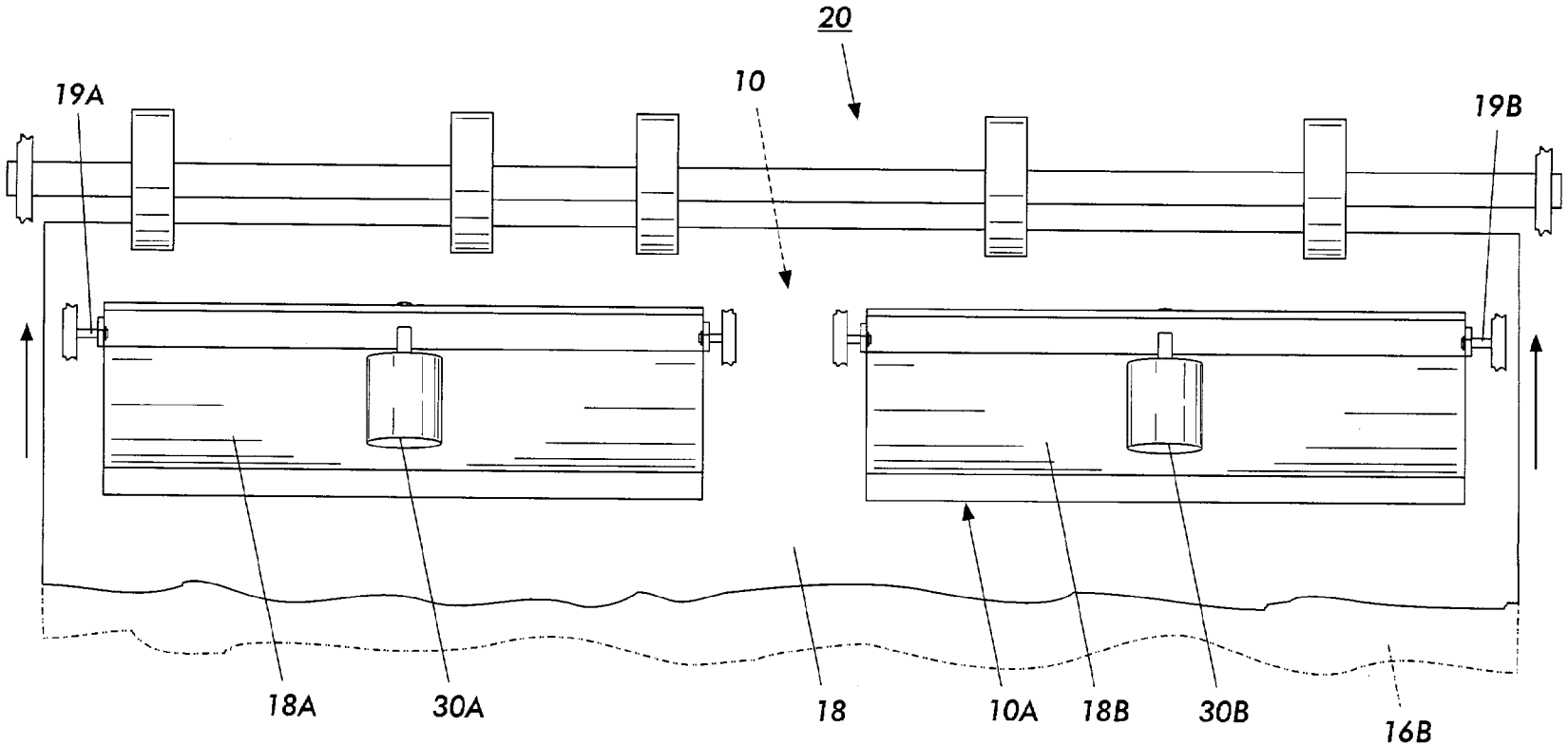
Figure 3:
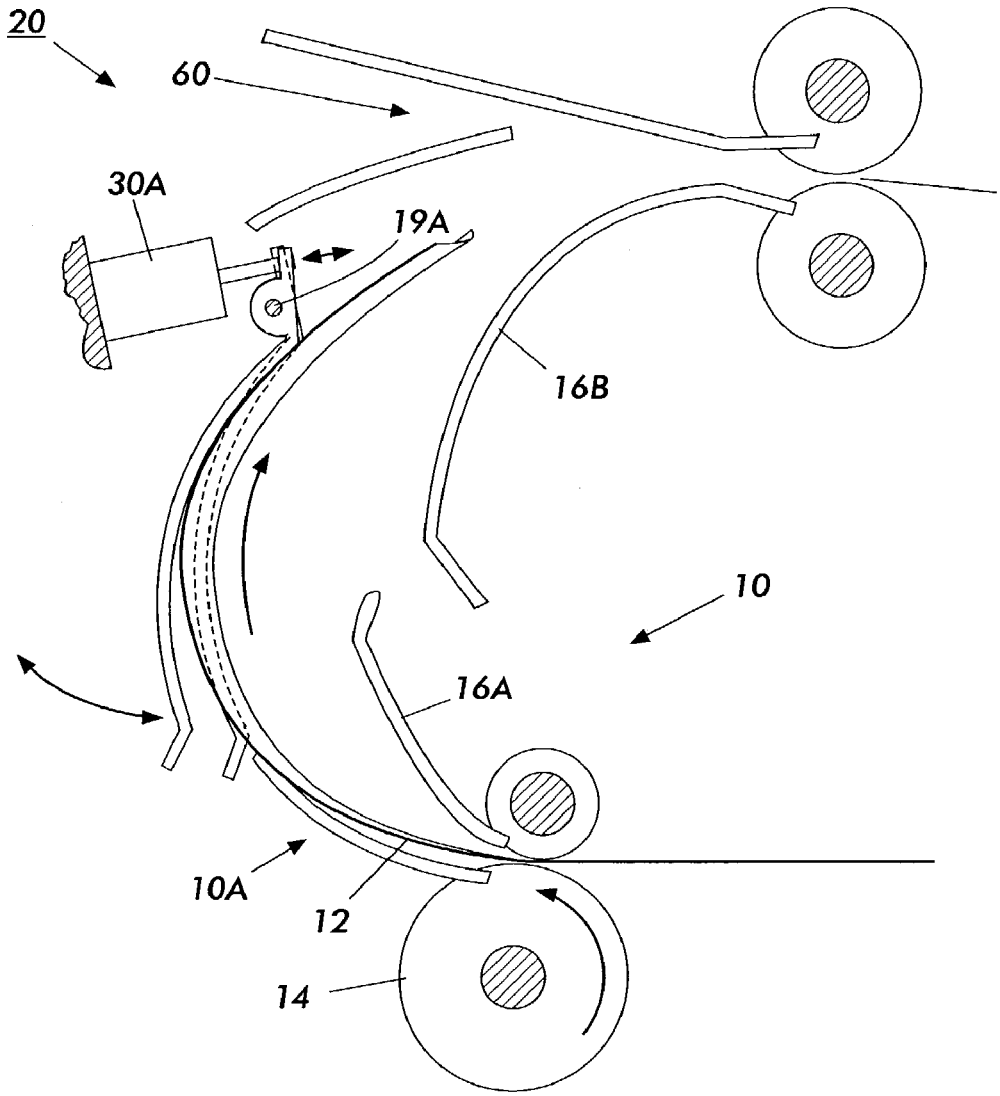

Various of the above-mentioned and further features and advantages will be apparent to those skilled in the art from the specific apparatus and its operations or methods described in the example below, and the claims. Thus, the present invention will be better understood from this description of this specific embodiment, including the drawing figures (which are approximately to scale) wherein:

FIG. 1 is a schematic front view of one example of the subject improved sheet registration system, FIG. 2 is a top view of the exemplary system of FIG. 1, and FIG. 3 is essentially the same as FIG. 1 but illustrating the pivotal movement of one of the split outer baffle members for registration of a skewed sheet.

The disclosed embodiment shows a split baffle for an improved stalled roller deskew system in a curved paper path. The stalled roll deskew in a curved paper path may be desirable particularly for a small, low cost reproduction apparatus, but has the problem that the sheet tends to follow the outside baffle and exhibits poor sheet deskew performance in the stalled nip even if the (single) outer baffle is pivoting. As disclosed in this example, the curved baffle may be split into two, inboard and outboard, baffles, so that one or both can be pivoted independently. Thus, providing a variable curved baffle buckle chamber for the sheet being registered by the stalled registration roll nips. These separate curved baffles may also pivot around the center line of the paper path. The sheet can then buckle by different amounts transversely of the paper path, to provide a resulting improvement in deskew performance, for registration of the sheet lead edge to all of the transfer stalled registration roll nips. The skew of the sheet may be sensed as it arrives at the registration roll nips by conventional optical or other sheet lead edge sensors. Separate solenoids, stepper motors or the like, providing baffle movement positioning systems, may then pivot the two separate curved baffle sections, one or both, to allow the different lateral buckling dimension difference of-the skewed sheet until registration is achieved for the sheet in the stalled roll nips. Alternatively, a spring loaded passive system could be employed.

Referring now in further detail to the specific sheet registration system 20 embodiment illustrated in the Figures, there is shown an arcuate portion 10A of a sheet path 10 of a printer, with a controller 100. The arcuate sheet path portion 10A here is defining an arcuate sheet buckle chamber and registration path, which is part of the paper path of a reproduction machine. Since the rest of this exemplary compact printer may be otherwise conventional, there is no need for it to be illustrated herein. Examples are provided in the above cited and numerous other patents. Each sheet 12 in this example is being driven into the arcuate sheet registration buckling area 10A by pre-registration rollers 14 in the sheet path 10 at the upstream end of the arcuate portion 10A. This arcuate sheet path portion 10A is defined here by inside baffle 16A, 16B, which may be fixed, and a large arcuate outside baffle system 18.

In this exemplary system 20, the outside baffle system 18 divided or split into at least two separate pivotable outside baffle sections 18A, 18B, inboard and outboard, respectively. Each of the outside baffle sections 18A, 18B is pivotable about axes 19A and 19B, which may be aligned. FIG. 3 illustrates an example of this pivotal movement between the illustrated solid and dashed lines positions of the inboard outside baffle segment 18A. The baffle sections 18A and 18B may be independently actively pivotable about their respective axis 19A and 19B by respective solenoids 30A and 30B in this example, or by an independent passive spring system for each baffle.

As described, these solenoids 30A, 30B may be controlled by plural conventional lead edge optical sensors 40 in, or closely adjacent to, the transverse nip line 50A of the stallable registration rolls 50. Additional sheet sensors may be placed upstream of the registration rolls in order to measure skew orientation and thus activate at least one baffle section.

It will be appreciated that these pivotable baffle sections 18A, 18B may form only a portion of the entire curved or arcuate portion 10A of the sheet path 10. That is, they may be curved baffle sections which fit into cutouts in otherwise fixed baffle sections, as particularly illustrated in FIG. 2.

The exemplary system 20 illustrated herein is for an approximately 180° arcuate sheet buckle chamber and registration path 10A for the duplex path of a printer, wherein the simplex path registration area is partially illustrated here by its separate entrance 60. However, it will be appreciated that, as for other features of this illustrative example 20, that the present invention is not limited thereto.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. In a sheet registration system for sheets in a sheet path defined by opposing sheet path baffles with a sheet feeding system in which a sheet is variably arcuately buckled in a buckle chamber in said opposing sheet path baffles against a transversely extending registration gate system in said sheet path, the improvement comprising a sheet deskewing system comprising a split baffles system with two transversely spaced and independently pivotal arcuate sheet path baffle sections upstream of said registration gate and a control system for pivoting said two independently pivotal arcuate sheet path baffle sections, in response to skewed sheets adjacent to said transversely extending registration gate system, by at least two different pivotal distances to provide at least two different dimensions of said buckle chamber transversely of said sheet path.

2. The sheet registration system of claim 1, in which a larger arcuate buckle chamber is automatically provided for one side of a skewed sheet than the other side of that skewed sheet in proportion to a sensed initial skew of the sheet by said control system differentially pivoting said two independently pivotal arcuate sheet path baffle sections.

3. The sheet registration system of claim 1, in which said two transversely spaced and independently pivotal arcuate sheet path baffle sections are pivotal about the same transverse pivotal axis.

4. The sheet registration system of claim 1, wherein said control system for pivoting said two independently pivotal arcuate sheet path baffle sections to provide two different sizes of buckle chambers transversely of said sheet path in response to skewed sheets adjacent to said transversely extending registration gate system includes sheet lead edge skew detection sensors at or adjacent to said transversely extending registration gate system.

5. The sheet registration system of claim 1, wherein said control system for pivoting said two independently pivotal arcuate sheet path baffle sections by at least two different pivotal distances comprises solenoids operatively connected to said independently pivotal arcuate sheet path baffle sections.

6. The sheet registration system of claim 1 wherein said sheet registration system is in the sheet path of a printer for providing registration of the sheet relative to an image to be printed onto the sheet.

7. A method of improved sheet deskewing and registration in which a sheet is fed in a sheet feeding direction through a spaced apart sheet lead-in baffle system to be deskewed and registered by engaging the lead edge of the sheet against a transversely extending temporary sheet lead edge registration stop system, with transversely variable buckling in a buckle chamber of at least a leading area of the sheet so engaged adjacent to said lead edge of said sheet when said sheet lead edge is initially skewed relative to said transversely extending temporary sheet lead edge registration stop system, comprising automatically increasing said spacing apart of one transverse side of said sheet lead-in baffle system relative to the other transverse side of said sheet lead-in baffle system in response to said sheet lead edge initial skew with differential movement of a split baffles system with two transversely spaced and independently pivotal arcuate sheet path baffle sections upstream of said registration gate by differently pivoting said two independently pivotal arcuate sheet path baffle sections in response to said skewed sheets by at least two different pivotal distances to provide at least two different dimensions of said buckle chamber transversely of said sheet path.

8. The method of improved sheet deskewing and registration of claim 7 wherein said independently pivotal arcuate sheet path baffle sections are pivoted in response to sheet skew sensing with sheet lead edge skew detection sensors at or adjacent to said temporary sheet lead edge registration stop system.

* * * * *